US008994473B2

(12) United States Patent
Naym et al.

(10) Patent No.: US 8,994,473 B2
(45) Date of Patent: Mar. 31, 2015

(54) MULTI-BAND FEED ASSEMBLY FOR LINEAR AND CIRCULAR POLARIZATION

(75) Inventors: Guy Naym, Netanya (IL); Hanan Keren, Kfar Saba (IL); Izik Krepner, Naharia (IL); Shiomo Levi, Shoham (IL)

(73) Assignee: Orbit Communication Ltd., Netanya (IL)

( * ) Notice: Subject to any disclaimer, the term of this patent is extended or adjusted under 35 U.S.C. 154(b) by 559 days.

(21) Appl. No.: 13/338,286

(22) Filed: Dec. 28, 2011

(65) Prior Publication Data

US 2012/0169557 A1 Jul. 5, 2012

Related U.S. Application Data

(60) Provisional application No. 61/428,248, filed on Dec. 30, 2010.

(51) Int. Cl.

| | |
|---|---|
| ***H01P 1/161*** | (2006.01) |
| ***H01Q 13/02*** | (2006.01) |
| ***H01Q 25/04*** | (2006.01) |
| ***H01P 1/17*** | (2006.01) |
| ***H01Q 5/00*** | (2006.01) |
| ***H01Q 15/24*** | (2006.01) |
| ***H01Q 19/13*** | (2006.01) |

(52) U.S. Cl.

CPC ..... *H01Q 13/0241* (2013.01); *H01Q 25/04* (2013.01); *H01P 1/17* (2013.01); *H01Q 5/0096* (2013.01); *H01Q 15/244* (2013.01); *H01Q 19/136* (2013.01)

USPC ..... 333/135; 333/21 A; 333/21 R

(58) Field of Classification Search

USPC ..... 342/188; 333/135, 21 A, 12 R

See application file for complete search history.

(56) References Cited

U.S. PATENT DOCUMENTS

| | | | | |
|---|---|---|---|---|
| 3,215,957 | A * | 11/1965 | Shelor, Jr. et al. | 333/21 R |
| 5,903,549 | A * | 5/1999 | von der Embse et al. | 370/310 |
| 6,329,957 | B1 | 12/2001 | Shea et al. | |
| 6,377,211 | B1 | 4/2002 | Hsiung | |
| 8,089,415 | B1 | 1/2012 | West | |
| 2011/0057849 | A1 | 3/2011 | Naym | |

* cited by examiner

*Primary Examiner* — Robert Pascal
*Assistant Examiner* — Kimberly Glenn
(74) *Attorney, Agent, or Firm* — Mark M. Friedman

(57) ABSTRACT

A waveguide has distal, medial and proximal sections. The distal and medial sections rotate relative to each other and to the proximal section. In a first configuration, the waveguide transforms linearly polarized electromagnetic radiation at the proximal end of the proximal section to linearly polarized electromagnetic radiation at the distal end of the distal section and vice versa. In a second configuration, the waveguide transforms linearly polarized radiation at the proximal end of the proximal section into circularly polarized electromagnetic radiation at the distal end of the distal section and vice versa. Preferably, the distal and medial sections include respective eight-wavelength polarizers and the proximal section includes a quarter-wavelength polarizer. A multi-band antenna feed includes two such waveguides, one nested inside the other, for transforming electromagnetic radiation of respective frequency bands.

17 Claims, 11 Drawing Sheets

MULTI-BAND FEED ASSEMBLY FOR LINEAR AND CIRCULAR POLARIZATION

This application claims priority of U.S. Provisional Patent Application No. 61/428,248, filed Dec. 30, 2010

FIELD AND BACKGROUND OF THE INVENTION

The present invention relates to electromagnetic communication between the ground and an orbiting satellite and, more particularly, to a feed assembly, for a ground station antenna, that supports communication with satellites that transmit and receive in several frequency bands and/or using linear and circular polarizations.

FIGS. 1A and 1B shows a typical parabolic dish antenna 10 for communicating with a communication satellite such as a Fixed Service Satellite (FSS). Antenna 10 includes a parabolic dish 12 and a Low Noise Block downconverter Feed horn (LNBF) 14 supported by supports 16 at the focus of dish 12. Dish 12 is mounted on a mount 18. FIG. 1A is a perspective view of antenna 10. FIG. 1B is a frontal view of dish 12 and LNBF 14. LNBF 14 includes a Low Noise Block (LNB) with two orthogonal receive dipoles 20 shown in FIG. 1B in phantom. Each dipole receives Ku-band signals from the FSS at which antenna 10 is aimed.

An FSS is a geostationary satellite whose transponders transmit and receive linearly polarized radio waves in the Ku-band. One transponder of a transponder pair transmits and receives horizontally polarized waves. The other transponder of the transponder pair transmits and receives vertically polarized waves. LNB dipoles 20 are intended for receiving signals in respective allocated frequency segments from respective transceivers of the FSS: the horizontal dipole antenna 20 is for receiving signals from the transponder that transmits horizontally polarized waves and the vertical dipole antenna 20 is for receiving signals from the transponder that transmits vertically polarized waves. If the FSS is at the same longitude as a stationary antenna 10, then when dish 12 is aimed at the FSS by appropriate adjustment of mount 18 in azimuth and elevation, the horizontal LNB dipole 20 is aligned with the horizontal polarization direction of the FSS and the vertical LNB dipole 20 is aligned with the vertical polarization of the FSS. If the FSS is not at the same longitude as a stationary antenna 10 then the polarization directions of the FSS are tilted with respect to LNB dipoles 20 and dish 12 must be rotated, as indicated by an arrow 22 in FIG. 1B, to align LNB dipoles 20 with the polarization directions of the FSS.

If antenna 10 is stationary, then dish 12 only needs to be rotated once and then fixed in place on mount 18. If antenna 10 is mounted on a moving platform such as a truck, a boat, an aircraft or some other vehicle, the orientation of dish 12 must be adjusted continuously to keep dish 12 pointed at the FSS and to keep LNB dipoles 20 aligned with the polarization directions of the FSS. Even if antenna 10 is stationary, if antenna 10 communicates with a satellite that is not in a geosynchronous obit, dish 12 must be adjusted continuously to keep dish 12 pointed at the satellite and to keep LNB dipoles 20 aligned with the satellite's polarization directions. Hsiung, in U.S. Pat. No. 6,377,211, teaches an antenna aiming apparatus for keeping an antenna that is mounted on a moving vehicle properly aligned with a satellite in a non-geosynchronous orbit. U.S. Pat. No. 6,377,211 is incorporated by reference for all purposes as if fully set forth herein.

U.S. patent application Ser. No. 12/555,007, which is incorporated by reference for all purposes as if fully set forth herein, teaches a LNBF that makes it unnecessary to rotate dish 12 as a whole, in the directions indicated by arrow 22, to keep LNB dipoles 20 aligned with the polarization directions of the satellite with which antenna 10 communicates.

FIGS. 2A-2D illustrate two embodiments 30 and 31 of a LNBF of U.S. Ser. No. 12/555,007. FIG. 2A is a side view of LNBF 30 showing that LNBF 30 includes, in series, a feed horn 48, a waveguide 50 and a LNB 35. FIG. 2B is a side view of LNBF 31 showing that LNBF 31 includes, in series, feed horn 48, waveguide 50 and an Orthogonal Mode Transducer (OMT) 36. Waveguide 50 includes a rotating distal section 32 and a fixed proximal section 34. FIG. 2C, a cross section of LNBF 30 through section A-A, shows that rotating distal section 32 of LNBF 30 includes a quarter-wavelength dielectric slab polarizer 42. FIG. 2D, a cross section of LNBF 30 through section B-B, shows that fixed proximal section 34 of LNBF 30 includes a quarter-wavelength dielectric slab polarizer 44. Also shown in phantom in FIG. 2D are the orientations of the horizontal dipole 38 and the vertical dipole 40 of LNB 35. Slab 44 is fixed at a 45-degree angle to both horizontal dipole 38 and vertical dipole 40. OMT 36 includes, instead of two orthogonal dipoles, a horizontal port 39 that corresponds to dipole 38 and a vertical port 41 that corresponds to dipole 39.

In general, a single quarter-wavelength dielectric slab polarizer that is placed at a 45-degree angle to a linearly polarized electromagnetic wave, transverse to the direction of propagation of the linearly polarized electromagnetic wave, transforms the linearly polarized electromagnetic wave to a circularly polarized electromagnetic wave. Appropriate rotation of just rotating distal section 32, as indicated by an arrow 46 in FIG. 2C, suffices to keep LNB dipoles 38 and 40 aligned with the polarization directions of the satellite with which an antenna that includes LNBF 30 communicates. Specifically, distal section 32 is rotated to place slab 42 at a 45-degree angle to the polarization directions of the satellite. Distal section 32 transforms the linearly polarized signal from the satellite to a circularly polarized signal, and fixed proximal section 34 transforms the circularly polarized signal to a linearly polarized signal that is aligned correctly with the appropriate LNB dipole 38 or 40. Mathematical details are provided in U.S. Ser. No. 12/555,007.

To minimize reflections in waveguide 50, slabs 42 and 44 should be tapered in the direction of propagation, as shown in FIG. 3. The lengths A and B should satisfy $2A+B \approx 0.25\lambda/\sqrt{\in}$, where $\lambda$ is the wavelength of the electromagnetic signal in free space and $\in$ is the dielectric constant of the dielectric material of slabs 42 and 44. Length C is tuned for optimal matching of the propagating wave through waveguide 50. Typical values of A, B and C for a Ku-band LNBF 30 are 2 mm, 4 mm and 4 mm, respectively. The dielectric material of slabs 42 and 44 should be of low loss tangent at the operating frequency, e.g. Plexiglas™ (polymethyl methacrylate).

FIG. 4, which is adapted from FIG. 2 of U.S. Pat. No. 6,377,211, is a simplified block diagram of a mechanism for pointing a parabolic dish antenna, that includes LNBF 31 and that is mounted on a moving vehicle, at a geostationary earth satellite while rotating distal section 32 to keep OMT ports 39 and 41 aligned with the polarization directions of the satellite. A Global Positioning System (GPS) receiver 110 mounted on the vehicle receives signals from GPS satellites in a known manner and produces signals that represent vehicle position, the current time (coordinated Universal Time or UPC) and a one-pulse-per-second timing pulse, all of which are applied to a Digital Signal Processor (DSP) 112. The vehicle position information includes latitude, longitude and altitude. A vehicle speed sensor 114 produces signals representing the speed of the vehicle, which are applied to DSP 112. DSP 112 also receives signals representing vehicles roll, inclination (pitch) and azimuth angle (yaw) from (an) appropriate sensor(s) 116 mounted on the vehicle. One such sensor is the Crossbow Model HDX-AHRS, available from Crossbow Technology, Inc. of San Jose Calif., that senses roll, inclination and azimuth angle, and that includes a three-axis magnetometer to make a true measurement of magnetic heading. The azimuth information may be in the form of signals representing vehicle yaw relative to magnetic north; magnetic correction then can be performed in DSP 112 based on the location information from GPS receiver 110 together with stored magnetic declination data. GPS receiver 110, orientation sensor(s) 116 and speed sensor 114 provide DSP 112 with data at an update rate faster than once per second, thereby allowing the antenna pointing system to have a near-real-time response.

The location of the satellite also is stored in DSP 112. DSP 112 processes the sensor signals relative to the location of the satellite to produce antenna drive or control signals, which are applied to the drive motors of the parabolic dish antenna, including a motor for rotating distal section 32, to keep LNBF 31 pointed at the satellite and to rotate distal section 32 to keep OMT ports 39 and 41 aligned with the polarization directions of the satellite.

It also is known to concentrically nest two or more waveguides, of a LNBF, that are tuned to two or more respective frequency bands, so that the ground station antenna can communicate with a satellite that transmits and receives in more than one frequency band without having to swap an LNBF of one band for an LNBF of another band. See, for example, West, U.S. Pat. No. 7,102,581, which is incorporated by reference for all purposes as if fully set forth herein.

It is shown in U.S. Ser. No. 12/555,007 that LNBF 30 can be used for communicating with a satellite that transmits and receives circularly polarized radio waves if slab 42 is kept at a 90 degree angle to slab 44. This is not the case with LNBF 31. It would be highly advantageous to have a LNBF, in which the proximal end of the waveguide is coupled to an OMT, and that can be used for communicating both with satellites that transmit and receive linearly polarized radio waves and with satellites that transmit and receive circularly polarized radio waves.

SUMMARY OF THE INVENTION

According to the present invention there is provided a waveguide including: (a) a distal section; (b) a medial section; and (c) a proximal section; wherein the distal section and the medial section are configured to rotate relative to each other and to relative to the proximal section; wherein, when the distal section and the medial section are in a first configuration relative to each other and to the proximal section, the waveguide transforms linearly polarized electromagnetic radiation input to a proximal end of the proximal section into linearly polarized electromagnetic radiation output from a distal end of the distal section and transforms linearly polarized electromagnetic radiation input to the distal end of the distal section into linearly polarized electromagnetic radiation output from the proximal end of the proximal section; wherein, when the distal section and the medial section are in a second configuration relative to each other and to the proximal section, the waveguide transforms linearly polarized electromagnetic radiation input to the proximal end of the proximal section into circularly polarized electromagnetic radiation output from the distal end of the distal section and transforms circularly polarized electromagnetic radiation input to the distal end of the distal section into linearly polarized electromagnetic radiation output from the proximal end of the proximal section; and wherein the distal section and the medial section are rotated differently with respect to each other in the second configuration than in the first configuration.

According to the present invention there is provided a back end, for an orthogonal mode transducer that includes a port for exchanging signals of a certain polarization, the back end including: (a) a diplexer, for being coupled operationally to the port; (b) a block up-converter; (c) a low noise block; (d) a receive reject filter wherethrough the block up-converter is operationally coupled to the diplexer; and (e) a transmit reject filter, wherethrough the low noise block is opearationally coupled to the diplexer.

A basic waveguide of the present invention includes three sections: a distal section, a medial section and a proximal section. The distal and medial sections are configured to rotate relative to each other and relative to the proximal section. When the distal and medial sections are in a first configuration relative to each other and to the proximal section, the waveguide transforms linearly polarized radiation that is input to the proximal end of the proximal section into linearly polarized electromagnetic radiation (usually but not necessarily polarized in a different direction) that is output from the distal end of the distal section (for example, for transmission to a satellite) and transforms linearly polarized electromagnetic radiation that is input to the distal end of the distal section into linearly polarized electromagnetic radiation (usually but not necessarily polarized in a different direction) that is output from the proximal end of the proximal section (for example for receiving transmissions from a satellite). When the distal and medial sections are in a second configuration relative to each other and to the proximal section, the waveguide transforms linearly polarized radiation that is input to the proximal end of the proximal section into circularly polarized electromagnetic radiation that is output from the distal end of the distal section (for example, for transmission to a satellite) and transforms circularly polarized electromagnetic radiation that is input to the distal end of the distal section into linearly polarized electromagnetic radiation that is output from the proximal end of the proximal section (for example for receiving transmissions from a satellite). The distal section and the medial section are rotated differently with respect to each other in the second configuration than in the first configuration.

Preferably, the distal and medial sections include respective eight-wavelength polarizers and the proximal section includes a quarter-wavelength polarizer. In some embodiments, the polarizers include respective dielectric slabs. In other embodiments, the polarizers are quad ridge polarizers.

Preferably, the angular orientation of the distal section to the medial section in the second configuration is displaced by 90 degrees from the angular orientation of the distal section to the medial section in the first configuration.

The scope of the present invention also includes an antenna feed that includes the waveguide of the present invention. Preferably, the antenna feed also includes an orthogonal mode transducer that is operationally coupled to the proximal end of the proximal section of the waveguide. Most preferably, the orthogonal mode transducer is fixedly attached to the proximal end of the proximal section of the waveguide.

Also most preferably, the orthogonal mode transducer includes a first port for exchanging vertically polarized signals and a second port for exchanging horizontally polarized signals. Each port has a diplexer operationally coupled thereto. A block up-converter is operationally coupled to the diplexer via a receive reject filter. A low noise block is operationally coupled to the diplexer via a transmit reject filter.

The scope of the present invention also includes a ground station antenna that includes the antenna feed of the present invention and a mechanism for rotating the distal and medial sections of the waveguide relative to each other and relative to the proximal section of the waveguide to place the waveguide alternately and reversibly in either of its two configurations.

The scope of the present invention also includes a multi-band antenna feed that includes two waveguides of the present invention, each waveguide for transforming electromagnetic radiation of respective frequency bands. One waveguide is nested within the other waveguide. The waveguides could have circular cross sections, in which case the inner waveguide is nested concentrically within the outer waveguide. Alternatively, the waveguides could have rectangular cross sections.

Preferably, the multi-band antenna feed also includes, for each waveguide, a respective orthogonal mode transducer operationally coupled to the proximal end of the proximal section of the waveguide. Each orthogonal mode transducer includes a first port for exchanging vertically polarized signals and a second port for exchanging horizontally polarized signals. Each port has a diplexer operationally coupled thereto. A block up-converter is operationally coupled to the diplexer via a receive reject filter. A low noise block is operationally coupled to the diplexer via a transmit reject filter.

The respective frequency bands of the waveguides could be the C and X-bands, the C and Ku-bands, the C and Ka-bands, the X and Ku-bands, the X and Ka-bands, or the Ku and Ka-bands.

The scope of the present invention also includes, as an invention in its own right, the kind of back end that is coupled to the orthogonal mode transducer(s) of the antenna feed(s) of the present invention: a diplexer for being coupled operationally to a port of the orthogonal mode transducer, a block up-converter coupled operationally to the diplexer via a receive reject filter, and a low noise block operationally coupled to the diplexer via a transmit reject filter.

BRIEF DESCRIPTION OF THE DRAWINGS

Various embodiments are herein described, by way of example only, with reference to the accompanying drawings, wherein.

DESCRIPTION OF THE PREFERRED EMBODIMENTS

The principles and operation of a feed assembly for a ground station antenna according to the present invention may be better understood with reference to the drawings and the accompanying description.

Figure 1A:
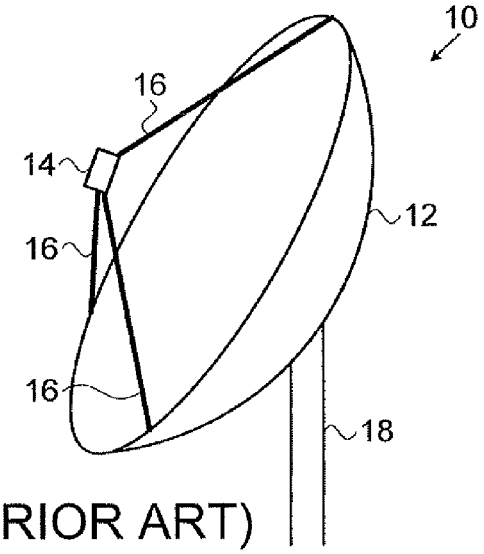
FIG. 1A (PRIOR ART)
FIGS. 1A and 1B show a prior art parabolic dish antenna.
Figure 1B:
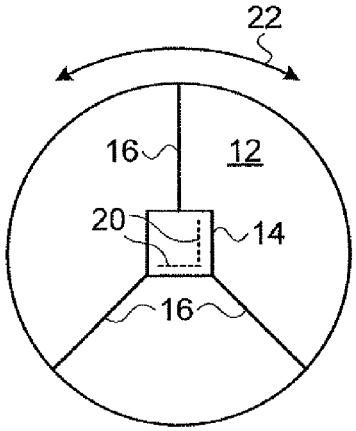
FIG. 1B (PRIOR ART)
Figure 2A:
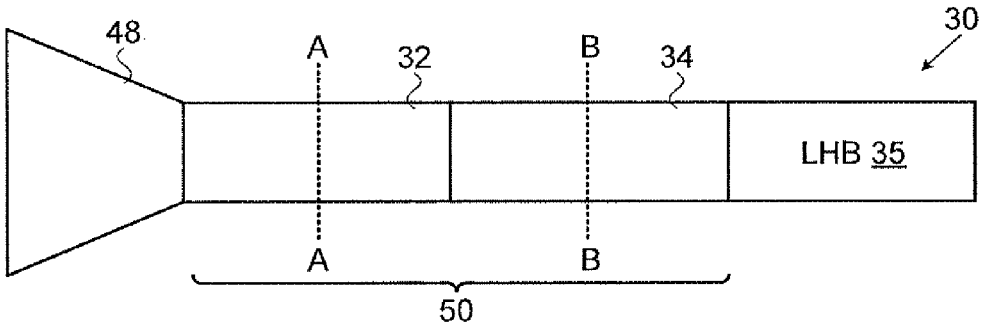
FIG. 2A (PRIOR ART)
FIGS. 2A-2D illustrate a prior art LNBF for keeping a moving ground station antenna aligned with a satellite that transmits and received linearly polarized electromagnetic waves.
Figure 2B:
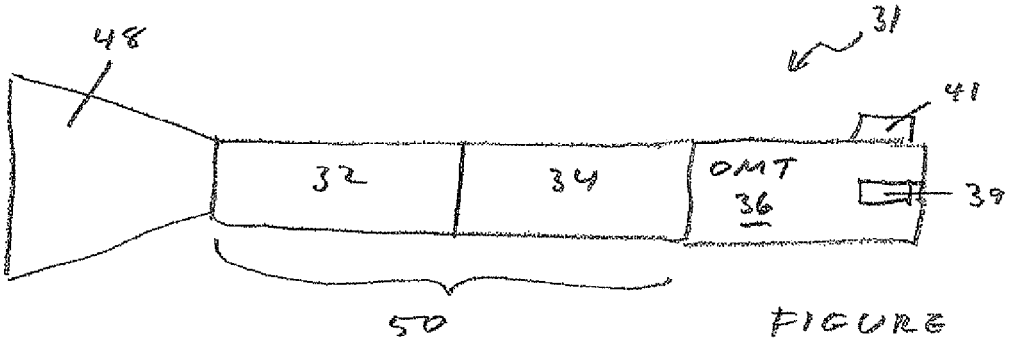
FIGURE 2B (PRIOR ART)
Figure 3:
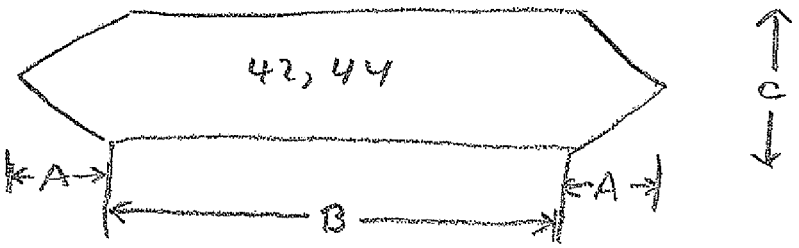
FIGURE 3 (PRIOR ART)
FIG. 3 illustrates the tapering of the dielectric slab polarizers of the LNBF of FIGS. 2A-2D.
Figure 2C:
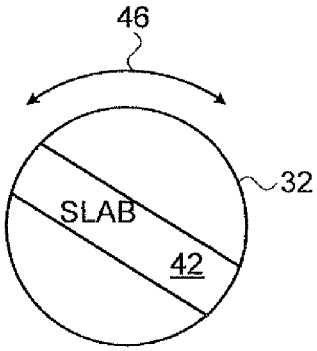
FIG. 2C (PRIOR ART)
Figure 2D:
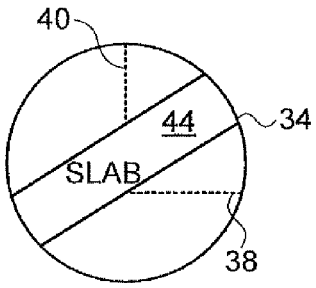
FIG. 2D (PRIOR ART)
Figure 5B:
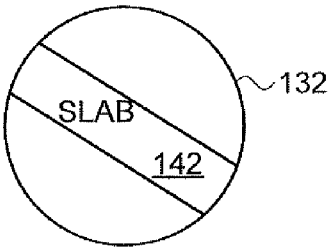
FIG. 5B (PRIOR ART)
FIGS. 5A-5E illustrate a LNBF of the present invention.
Figure 6:
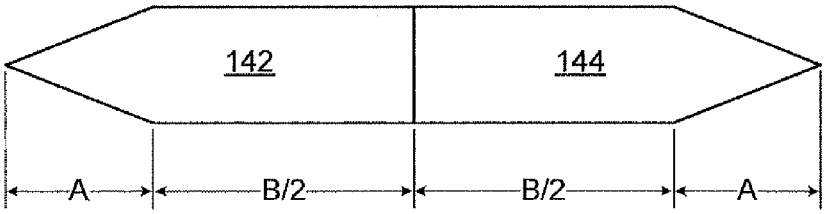
FIG. 6 illustrates the tapered eighth-wavelength dielectric slab polarizers of the LNBF of FIGS. 5A-5E.
Figure 4:
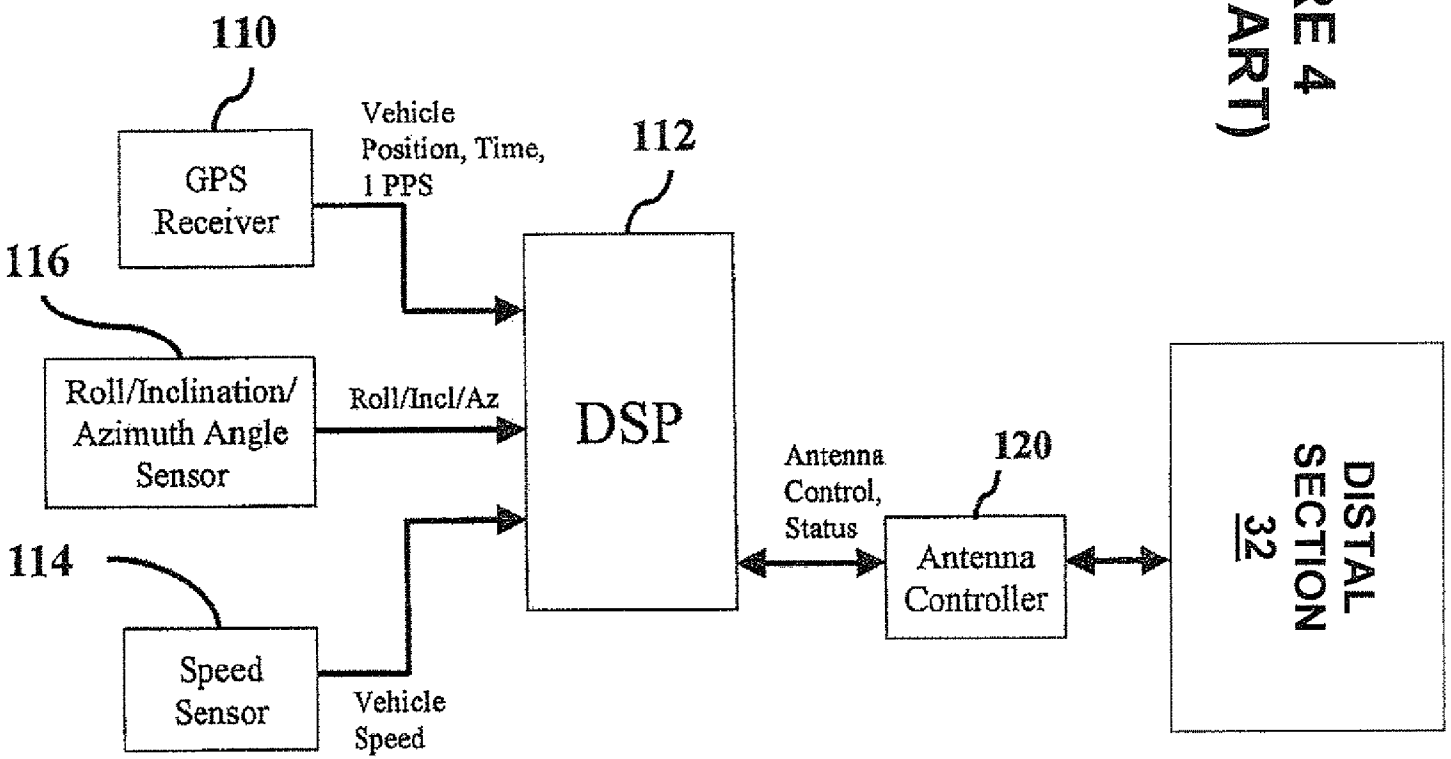
FIGURE 4 (PRIOR ART)
FIG. 4 is a simplified block diagram of a prior art mechanism for pointing a moving ground station antenna at a geostationary satellite.
Figure 5A:
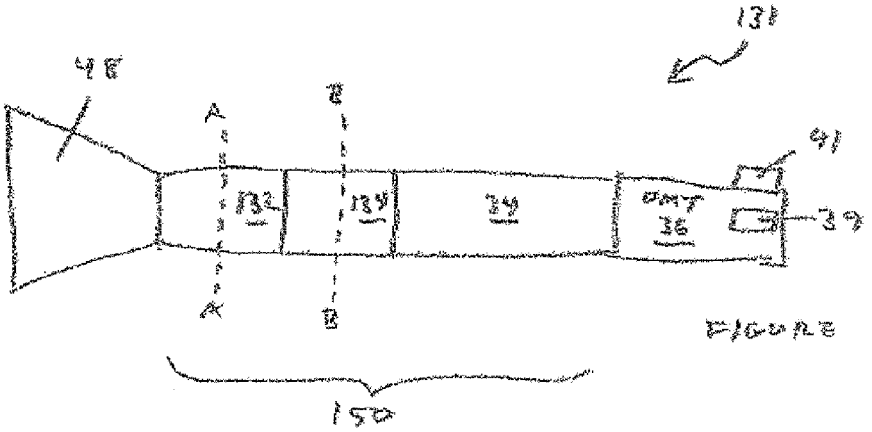
Figure 5C:
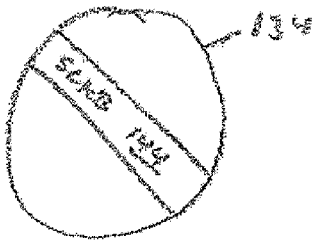
Figure 5D:
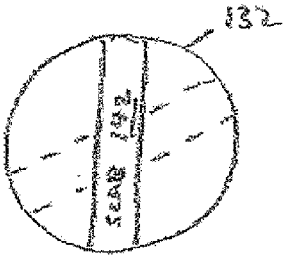
Figure 5E:
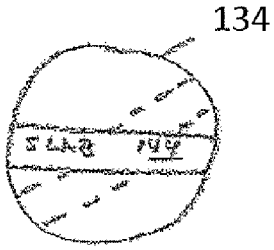

The present invention is based on the insight that a straightforward modification of LNBF 31 renders LNBF 31 suitable for communicating either with a satellite that transmits and receives linearly polarized electromagnetic radiation or with a satellite that transmits and receives circularly polarized electromagnetic radiation. Referring again to the drawings, FIGS. 5A-5E and 6 illustrate such a modified LNBF 131. LNBF 131 is LNBF 31 with distal section 32 of waveguide 50 split into two rotating sections of a waveguide 150: a rotating distal section 132 and a rotating medial section 134. Dielectric slab 42 is split transversely in half, into two dielectric slabs 142 and 144, as shown in FIG. 6. As shown in FIGS. 5B and 5C, to communicate with a satellite that transmits and receives linearly polarized electromagnetic radiation, distal section 132 and medial section 134 are rotated together, in the same manner as distal section 32, with dielectric slabs 142 and 144 held parallel, so that dielectric slabs 142 and 144 function identically to dielectric slab 43. FIGS. 5B and 5C are cross sections of LNBF 131 through sections A-A and B-B that correspond to FIG. 2C. As shown in FIGS. 5D and 5E, that also are cross-sections of LNBF 131 through sections A-A and B-B, to communicate with a satellite that transmits and receives circularly polarized electromagnetic radiation, distal section 132 is rotated so that dielectric slab 142 is oriented 45 degrees counter-clockwise relative to dielectric slab 44 and medial section 134 is rotated so that dielectric slab 144 is oriented 45 degrees clockwise relative to dielectric slab 44. In FIGS. 5D and 5E, dielectric slab 44 is shown in phantom behind dielectric slabs 142 and 144. It can be shown that if dielectric slab 142 is held at the 45 degree counter-clockwise orientation relative to dielectric slab 44 that is shown in FIG. 5D and dielectric slab 144 is held at the 45 degree clockwise orientation relative to dielectric slab 44 that is shown in FIG. 5E, then circularly polarized transmissions from a satellite that are received at feed horn 48 are transformed to linearly polarized received signals at OMT 36 and linearly polarized transmitted signals at OMT 36 are transformed into circularly polarized transmissions to the satellite at feed horn 48. The ground station antenna in which LNBF 131 is mounted is provided with two motors for rotating distal section 132 and medial section 134, in place of the single prior art motor for rotating distal section 32. For communicating from a moving platform with a satellite that transmits and receives linearly polarized electromagnetic radiation, the motors rotate distal section 132 and medial section 134 together the way the prior art motor rotates distal section 32. For communicating with a satellite that transmits and receives circularly polarized electromagnetic radiation, one motor rotates distal section 132 to the orientation shown in FIG. 5D and holds distal section 132 in that orientation, and the other motor rotates medial section 134 to the orientation shown in FIG. 5E and then holds medial section 134 in that orientation.

Figure 7A:
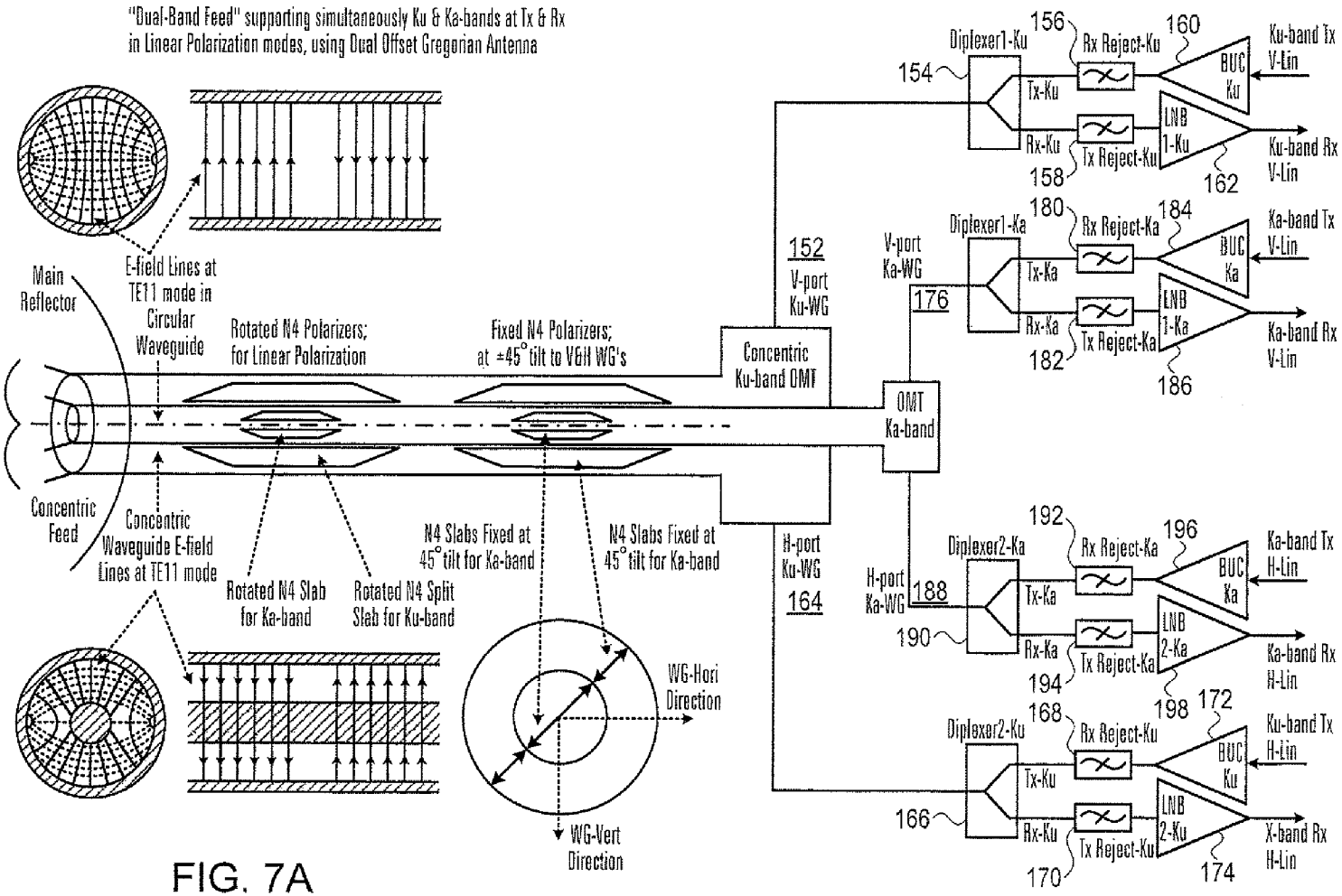
FIGS. 7A-7C show dual-band antenna feeds of the present invention, each with its two nested waveguides configured for communicating with a satellite that transmits and receives linearly polarized electromagnetic radiation.
Figure 8A:
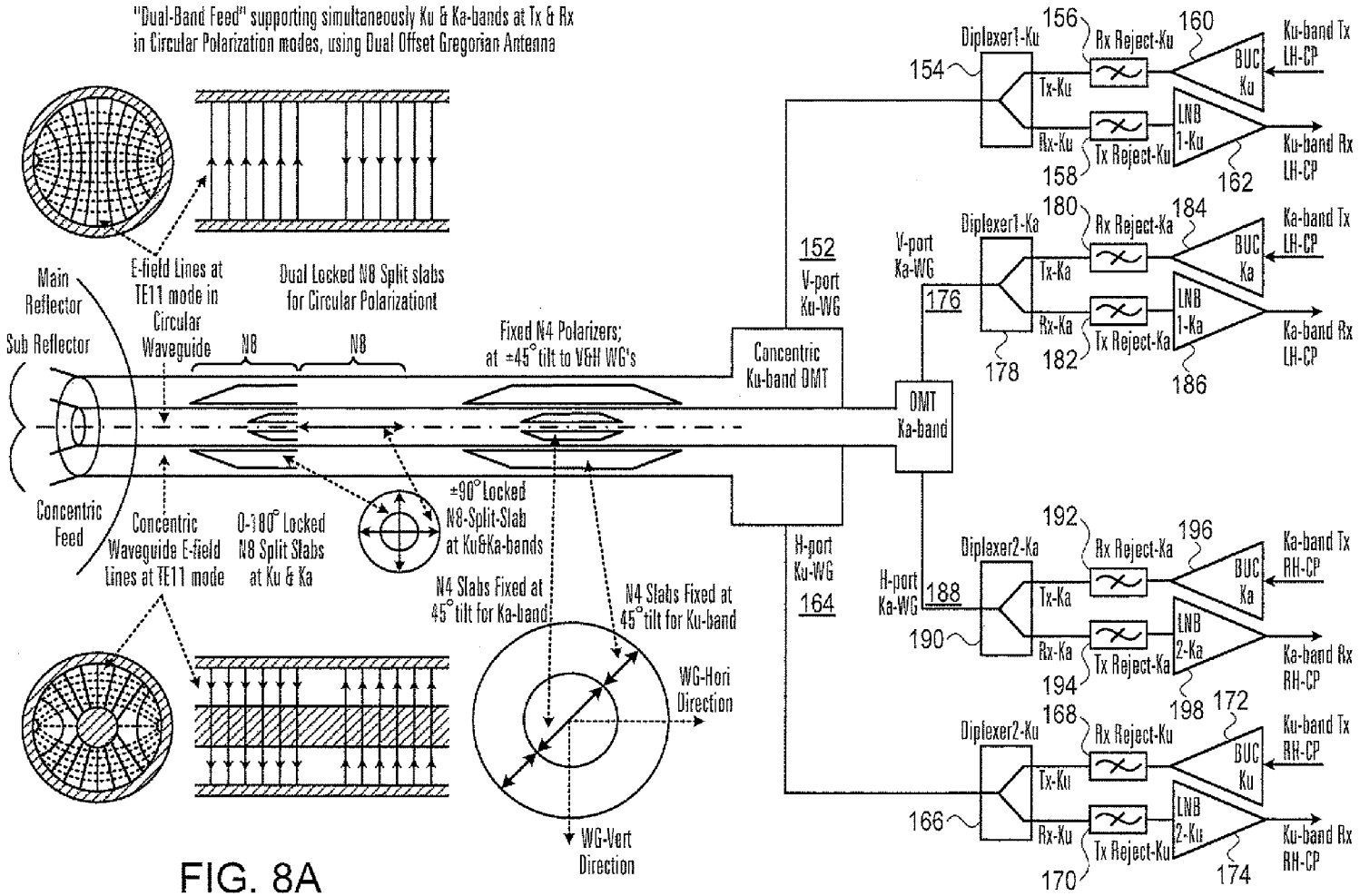
FIG. 8A-8C show dual-band antenna feeds of the present invention, each with its two nested waveguides configured for communicating with a satellite that transmits and receives circularly polarized electromagnetic radiation.

Just as prior art waveguides can be nested concentrically to enable a ground station antenna to communicate with a satellite that transmits and receives in more than one frequency band, so waveguides of the present invention can be nested concentrically to enable a ground station antenna to communicate with a satellite that transmits and receives in more than one frequency band. FIGS. 7A and 8A show a dual-band antenna feed, of the present invention, that includes two concentrically nested waveguides of the present invention, each with its respective OMT and back end. The inner waveguide is for communicating in the Ka-band (17.7 GHz to 31 GHz). The outer waveguide is for communicating in the Ku-band (10.7 GHz to 14.5 GHz). FIG. 7A shows the two waveguides configured for communicating with a satellite that transmits and receives linearly polarized electromagnetic radiation: distal sections 132 and medial sections 134 of the waveguides rotate together to function as quarter-wavelength polarizers. FIG. 8A shows the two waveguides configured for communicating with a satellite that transmits and receives circularly polarized electromagnetic radiation: distal sections 132 and medial sections 134 of the waveguides are fixed in place as separate eighth-wavelength polarizers.

Insets in FIGS. 7A and 8A also show that the propagation mode in the waveguides is the $TE_{11}$ mode.

Each OMT in FIG. 7A is coupled to its own back end for receiving vertically and horizontally polarized signals to transmit from respective Block Up-Converters (BUCs) and for sending received vertically and horizontally polarized signals to respective LNBs. The vertical polarization port 152 of the Ku-band OMT is coupled, via a diplexer 154 and a receive reject filter 156, to the Ku-band vertical polarization BUC 160, and, via diplexer 154 and a transmit reject filter 158, to the Ku-band vertical polarization LNB 162. The horizontal polarization port 164 of the Ku-band. OMT is coupled, via a diplexer 166 and a receive reject filter 168, to the Ku-band horizontal polarization BUC 172, and, via diplexer 166 and a transmit reject filter 170, to the Ku-band horizontal polarization LNB 174. Similarly, the vertical polarization port 176 of the Ka-band OMT is coupled, via a diplexer 178 and a receive reject filter 180, to the Ka-band vertical polarization BUC 184, and, via diplexer 178 and a transmit reject filter 182, to the Ka-band vertical polarization LNB 186; and the horizontal polarization port 188 of the Ka-band OMT is coupled, via a diplexer 190 and a receive reject filter 192, to the Ka-band horizontal polarization BUC 196, and, via diplexer 190 and a transmit reject filter 194, to the Ka-band horizontal polarization LNB 198. To achieve the required Cross Polarization Discrimination (XPD) of better than 30 dB in transmission and better than 25 dB in reception, the diplexers and the filters need to be load-matched in their respective bands. These back ends support simultaneous transmission and reception in both polarizations in both frequency bands.

The following table shows the XPD of the configuration of FIG. 7A.

| | Rx frequency (GHz) | Tx frequency (GHz) | XPD in Rx | XPD in Tx |
|---|---|---|---|---|
| Ku-band | 10.7-12.75 | 13.75-14.5 | >25 | >30 |
| Ka-band | 17.7-21.2 | 27.5-31 | >20 | >25 |

The following table shows the XPD of the configuration of FIG. 8A.

| | Rx frequency (GHz) | Tx frequency (GHz) | XPD in Rx | XPD in Tx |
|---|---|---|---|---|
| Ku-band | 10.7-12.75 | 13.75-14.5 | >22 | >27 |
| Ka-band | 17.7-21.2 | 27.5-31 | >17 | >22 |

Figure 7B:
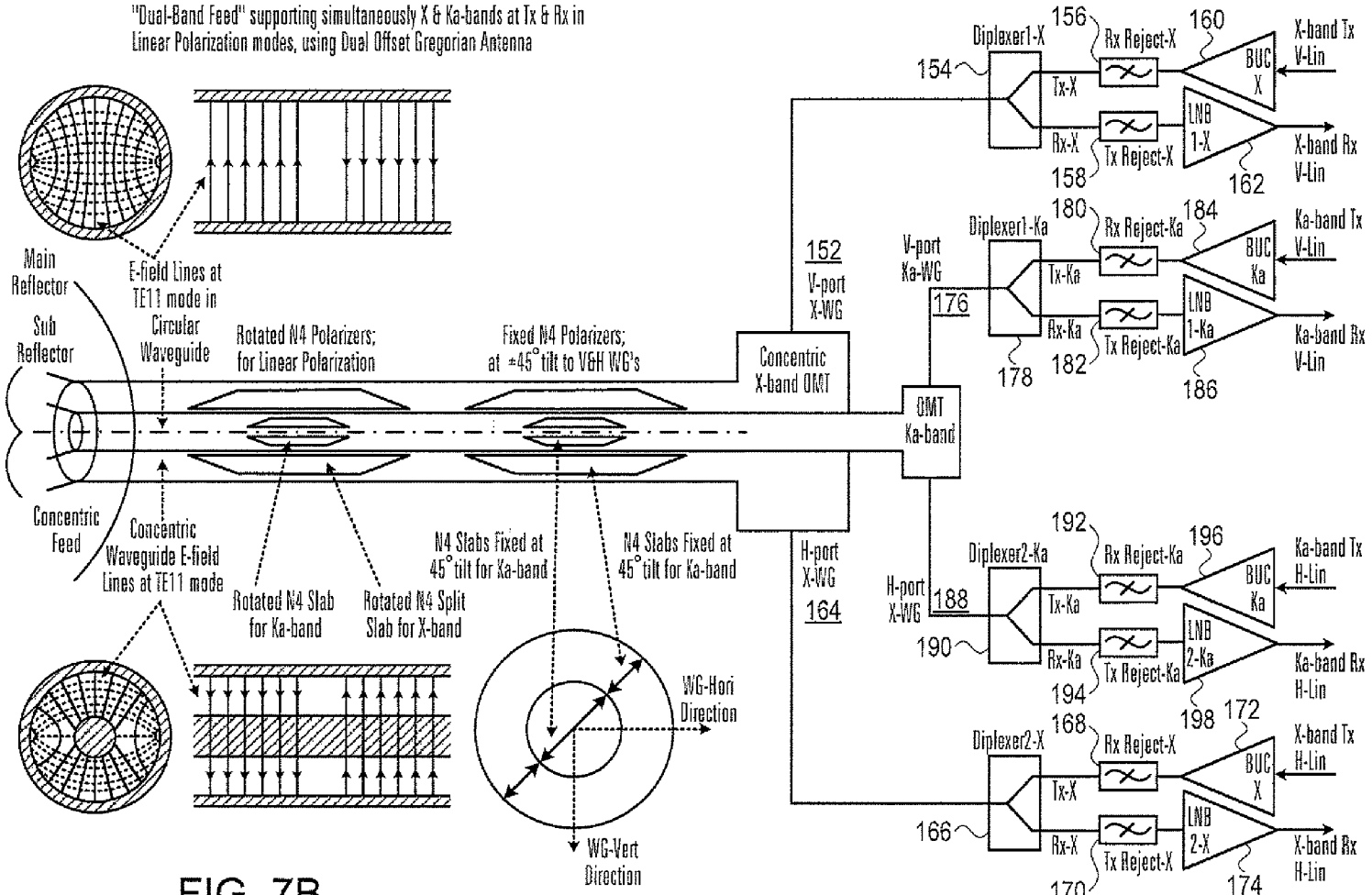

Waveguides of the present invention that are tuned to other frequency bands can be nested similarly and can be provided with similar, load-matched back ends. The following table shows the XPD of a nested waveguide configuration for linear polarization that is similar to the configuration of FIG. 7A but in which the inner waveguide is for the Ka-band and the outer waveguide is for the X-band (7.25 GHz to 8.4 GHz). This nested waveguide configuration is illustrated in FIG. 7B.

| | Rx frequency (GHz) | Tx frequency (GHz) | XPD in Rx | XPD in Tx |
|---|---|---|---|---|
| Ka-band | 17.7-21.2 | 27.5-31 | >20 | >25 |
| X-band | 7.25-7.75 | 7.9-8.4 | >25 | >30 |

Figure 8B:
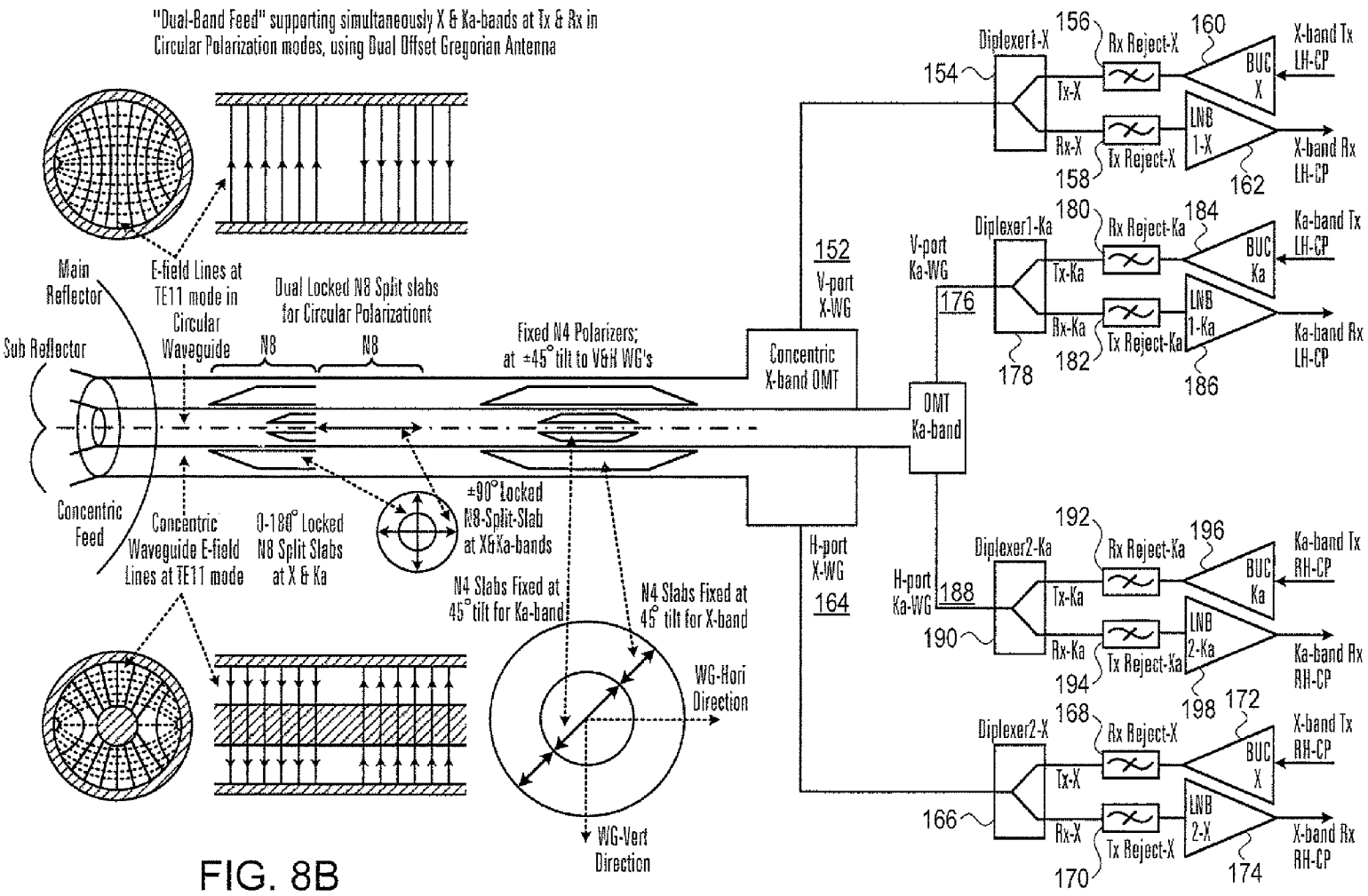

The following table shows the XPD of a nested waveguide configuration for circular polarization that is similar to the configuration of FIG. 8A but in which the inner waveguide is for the Ka-band and the outer waveguide is for the X-band. This nested waveguide configuration is illustrated in FIG. 8B.

| | Rx frequency (GHz) | Tx frequency (GHz) | XPD in Rx | XPD in Tx |
|---|---|---|---|---|
| Ka-band | 17.7-21.2 | 27.5-31 | >17 | >22 |
| X-band | 7.25-7.75 | 7.9-8.4 | >22 | >27 |

Figure 7C:
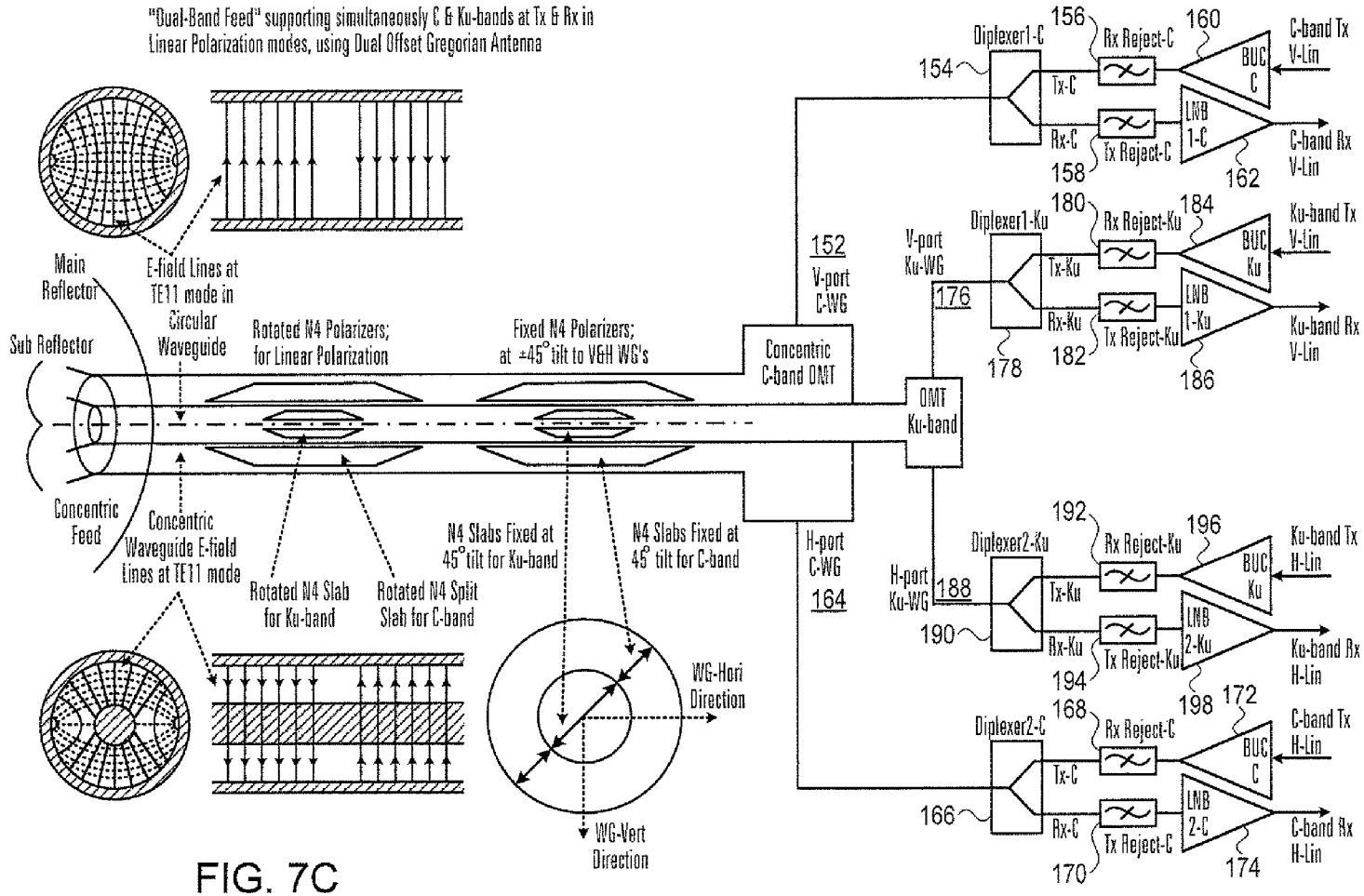

The following table shows the XPD of a nested waveguide configuration for linear polarization that is similar to the configuration of FIG. 7A but in which the inner waveguide is for the Ku-band and the outer waveguide is for the C-band (3.4 GHz to 6.725 GHz). This nested waveguide configuration is illustrated in FIG. 7C.

| | Rx frequency (GHz) | Tx frequency (GHz) | XPD in Rx | XPD in Tx |
|---|---|---|---|---|
| Ku-band | 10.7-12.75 | 13.75-14.5 | >25 | >30 |
| C-band | 3.625-4.2 | 5.85-6.425 | >20 | >25 |

Figure 8C:
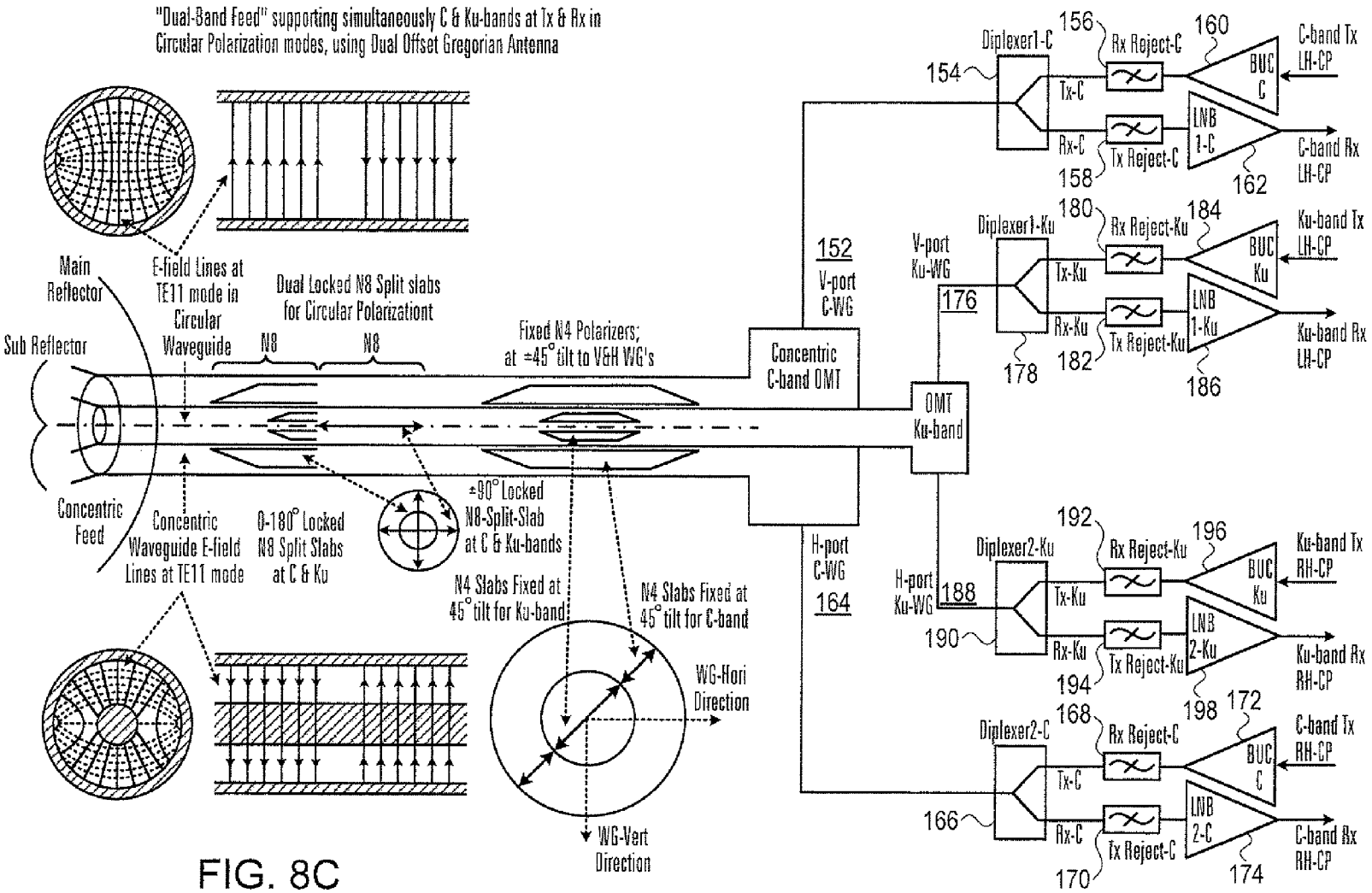

The following table shows the XPD of a nested waveguide configuration for circular polarization that is similar to the configuration of FIG. 8 but in which the inner waveguide is for the Ku-band and the outer waveguide is for the C-band. This nested waveguide configuration is illustrated in FIG. 8C.

| | Rx frequency (GHz) | Tx frequency (GHz) | XPD in Rx | XPD in Tx |
|---|---|---|---|---|
| Ku-band | 10.7-12.75 | 13.75-14.5 | >22 | >27 |
| C-band | 3.625-4.2 | 5.85-6.425 | >17 | >22 |

The present invention is not limited to only two nested waveguides. The following table shows the preferred cross-sectional dimensions of two configurations of four nested waveguides for simultaneous transmission and reception in all four of the bands that are used for satellite communication. One configuration uses nested concentric waveguides of circular cross-section. The other configuration uses nested waveguides of rectangular cross-section. The innermost waveguide is the Ka-band waveguide that is nested inside a Ku-band waveguide. The Ku-band waveguide is nested inside an X-band waveguide. The X-band waveguide is nested inside a C-band waveguide.

| Frequency band | Circular cross-section Inner diameter (mm) | Circular cross-section Outer diameter (mm) | Rectangular cross section Height (mm) | Rectangular cross section Width (mm) |
|---|---|---|---|---|
| Ka | | 12.79 | 4.32 | 10.67 |
| Ku | 12.79 | 26.15 | 9.53 | 19.05 |
| X | 26.15 | 45.62 | 12.62 | 28.50 |
| C | 45.62 | 80.65 | 29.08 | 58.17 |

The Ku-band XPDs configurations of FIGS. 7 and 8 are adequate for separate transmission and reception but not for simultaneous transmission and reception. U.S. Ser. No. 12/555,007 points out that the dual quad ridge polarizer of Vezmar, U.S. Pat. No. 6,097,264, gives better XPD than the dielectric slab design described above. Using dual quad ridge polarizers in the distal 132, medial 134 and proximal 34 sections of a Ka waveguide 150 gives XPDs of >35 dB in transmission and >20 dB in reception.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A multi-band antenna feed comprising:

a first waveguide and a second waveguide, each said waveguide including:

(a) a distal section;

(b) a medial section; and (c) a proximal section;

wherein said distal section and said medial section are configured to rotate relative to each other and relative to said proximal section;

wherein, when said distal section and said medial section are in a first configuration relative to each other and to said proximal section, the waveguide transforms linearly polarized electromagnetic radiation input to a proximal end of said proximal section into linearly polarized electromagnetic radiation output from a distal end of said distal section and transforms linearly polarized electromagnetic radiation input to said distal end of said distal section into linearly polarized electromagnetic radiation output from said proximal end of said proximal section;

wherein, when said distal section and said medial section are in a second configuration relative to each other and to said proximal section, the waveguide transforms linearly polarized electromagnetic radiation input to said proximal end of said proximal section into circularly polarized electromagnetic radiation output from said distal end of said distal section and transforms circularly polarized electromagnetic radiation input to said distal end of said distal section into linearly polarized electromagnetic radiation output from said proximal end of said proximal section;

wherein said distal section and said medial section are rotated differently with respect to each other in said second configuration than in said first configuration, wherein (i) said first waveguide is configured for transforming said electromagnetic radiation of a first frequency band; and (ii) said second waveguide is nested within said first waveguide and configured for transforming said electromagnetic radiation of a second frequency band that is different from said first frequency band.

2. The multi-band antenna feed of claim 1 wherein in each said waveguide, said distal section and said medial section include respective eighth-wavelength polarizers, and said proximal section includes a quarter-wavelength polarizer.

3. The multi-band antenna feed of claim 1, wherein each said polarizer includes a respective dielectric slab.

4. The multi-band antenna feed of claim 1, wherein each said polarizer is a quad ridge polarizer.

5. The multi-band antenna feed of claim 1, wherein an angular orientation of said distal section to said medial section in said second configuration is displaced by 90 degrees from an angular orientation of said distal section to said medial section in said first configuration.

6. An antenna feed comprising the multi-band antenna feed of claim 1.

7. The antenna feed of claim 6, further comprising an orthogonal mode transducer operationally coupled to said proximal end of said proximal section.

8. The antenna feed of claim 7, wherein said orthogonal mode transducer is fixedly attached to said proximal end of said proximal section.

9. The antenna feed of claim 7, wherein said orthogonal mode transducer includes a first port for exchanging vertically polarized signals and a second port for exchanging horizontally polarized signals, and wherein the antenna feed further comprises, for each said port:

(a) a diplexer, operationally coupled to said each port;

(b) a block up-converter;

(c) a low noise block;

(d) a receive reject filter wherethrough said block up-converter is operationally coupled to said diplexer; and (e) a transmit reject filter, wherethrough said low noise block is operationally coupled to said diplexer.

10. A ground station antenna comprising:

(a) the antenna feed of claim 6; and (b) a mechanism for rotating said distal section and said medial section relative to each other and relative to said proximal section to place said waveguide alternately and reversibly in said first and second configurations.

11. The multi-band antenna feed of claim 1, wherein each said waveguide has circular cross-sections and wherein said second waveguide is nested concentrically within said first waveguide.

12. The multi-band antenna feed of claim 1, wherein each said waveguide has rectangular cross-sections.

13. The multi-band antenna feed of claim 1, further comprising:

(c) for each said waveguide, a respective orthogonal mode transducer operationally coupled to said proximal end of said proximal section of said each waveguide.

14. The multi-band antenna feed of claim 13, wherein each said orthogonal mode transducer includes a first port for exchanging vertically polarized signals and a second port for exchanging horizontally polarized signals, and wherein the multi-band antenna feed further comprises, for each said port:

(a) a diplexer, operationally coupled to said each port;

(b) a block up-converter;

(c) a low noise block;

(d) a receive reject filter where through said block up-converter is operationally coupled to said diplexer; and (e) a transmit reject filter, wherethrough said low noise block is operationally coupled to said diplexer.

15. The multi-band antenna feed of claim 1, wherein said first and second frequency bands are selected from the group consisting of:

(a) one of said frequency bands is a C-band and another of said frequency bands is an X-band;

(b) one of said frequency bands is a C-band and another of said frequency bands is a Ku-band;

(c) one of said frequency bands is a C-band and another of said frequency bands is a Ka-band;

(d) one of said frequency bands is an X-band and another of said frequency bands is a Ku-band;

(e) one of said frequency bands is an X-band and another of said frequency bands is a Ka-band; and (f) one of said frequency bands is a Ku-band and another of said frequency bands is a Ka-band.

16. A back end, for an orthogonal mode transducer that includes a port for exchanging signals of a certain polarization, the back end comprising:

(a) a diplexer, for being coupled operationally to said port;

(b) a block up-converter;

(c) a low noise block;

(d) a receive reject filter wherethrough said block up-converter is operationally coupled to said diplexer; and (e) a transmit reject filter, wherethrough said low noise block is operationally coupled to said diplexer, wherein said diplexer is load matched to said filters in a band where the signals are being exchanged.

17. A waveguide comprising:

(a) a distal section;

(b) a medial section; and (c) a proximal section;

wherein said distal section and said medial section are configured to rotate relative to each other and relative to said proximal section;

wherein, when said distal section and said medial section are in a first configuration relative to each other and to said proximal section, the waveguide transforms linearly polarized electromagnetic radiation input to a proximal end of said proximal section into linearly polarized electromagnetic radiation output from a distal end of said distal section and transforms linearly polarized electromagnetic radiation input to said distal end of said distal section into linearly polarized electromagnetic radiation output from said proximal end of said proximal section;

wherein, when said distal section and said medial section are in a second configuration relative to each other and to said proximal section, the waveguide transforms linearly polarized electromagnetic radiation input to said proximal end of said proximal section into circularly polarized electromagnetic radiation output from said distal end of said distal section and transforms circularly polarized electromagnetic radiation input to said distal end of said distal section into linearly polarized electromagnetic radiation output from said proximal end of said proximal section;

wherein said distal section and said medial section are rotated differently with respect to each other in said second configuration than in said first configuration; and wherein said distal section and said medial section include respective eighth-wavelength polarizers, and said proximal section includes a quarter-wavelength polarizer.

* * * * *

UNITED STATES PATENT AND TRADEMARK OFFICE

CERTIFICATE OF CORRECTION

PATENT NO. : 8,994,473 B2
APPLICATION NO. : 13/338286
DATED : March 31, 2015
INVENTOR(S) : Guy Naym et al.

It is certified that error appears in the above-identified patent and that said Letters Patent is hereby corrected as shown below:

ON THE TITLE PAGE

(75) Inventor

Should be corrected from:

--Shiomo Levi, Shoham (IL)--

To read:

"Shlomo Levi, Shoham (IL)"

Signed and Sealed this
Twenty-seventh Day of October, 2015

Michelle K. Lee

Michelle K. Lee
*Director of the United States Patent and Trademark Office*